US008833924B2

(12) United States Patent
Velasco et al.

(10) Patent No.: US 8,833,924 B2
(45) Date of Patent: Sep. 16, 2014

(54) SYSTEMS FOR SUPPLYING HEATED AIR TO PRINTED INK

(75) Inventors: Antonio Monclus Velasco, Castelldefels Barcelona (ES); Xavier Soler Pedemonte, Barcelona Barcelona (ES); Fco Javier Pèrez Gellida, Sant Cugat (ES); Emilio Angulo Navarro, Barcelona (ES); Jesùs Garcia Maza, Terrassa Barcelona (ES); Elena Laso Plaza, Barcelona Barcelona (ES); Francisco Javier Rodriguez Escañuela, Mataro (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 89 days.

(21) Appl. No.: 13/542,235

(22) Filed: Jul. 5, 2012

(65) Prior Publication Data

US 2014/0009546 A1 Jan. 9, 2014

(51) Int. Cl.
*B41J 2/01* (2006.01)
*B41J 11/00* (2006.01)

(52) U.S. Cl.
CPC ..... *B41J 11/002* (2013.01); *B41J 11/0015* (2013.01)
USPC ..... 347/102; 347/101; 347/104

(58) Field of Classification Search
CPC ..... B41J 11/002; B41J 11/003; B41J 11/0015
USPC ..... 347/101, 102, 104
See application file for complete search history.

(56) References Cited

U.S. PATENT DOCUMENTS

| | | | | |
|---|---|---|---|---|
| 6,092,891 | A | 7/2000 | Okubo et al. | |
| 6,256,903 | B1 | 7/2001 | Rudd | |
| 6,463,674 | B1 | 10/2002 | Meyers et al. | |
| 6,877,247 | B1 | 4/2005 | DeMoore | |
| 2003/0156177 | A1 * | 8/2003 | Nishikawa et al. | 347/102 |
| 2010/0245513 | A1 * | 9/2010 | Ihara | 347/102 |

OTHER PUBLICATIONS

A. S. Mujumdar, "Impingement Drying," Copyright 2006 Taylor & Francis Group, LLP., 12 pp. [Online] http://203.158.253.140/media/e-Book/Engineer/Process/Handbook%20of%20Industrial%20Drying/DK4102_C015.pdf.

* cited by examiner

*Primary Examiner* — Henok Legesse

(57) ABSTRACT

System for supplying ink printed on a print medium comprises a heater to heat air, an impingement plate with a plurality of holes, and a blower for blowing heated air through the holes of the impingement plate onto the print medium. The impingement flux length in the system which may be defined as the length of the impingement plate through which heated air is blown, is adjustable.

15 Claims, 4 Drawing Sheets

SYSTEMS FOR SUPPLYING HEATED AIR TO PRINTED INK

BACKGROUND

A printer is generally used for (re)producing text and images. Throughout this application, when reference is made to an image or images, this is to be interpreted as also explicitly referring to text (not only figures).

Different types of printers are known, amongst which laser printers, thermal printers, dot matrix printers and inkjet printers.

Inkjet printers use at least one printhead provided with a plurality of nozzles, from which ink droplets are fired or ejected onto the media (or fluid in the case of pre/post treatments); the printer controls the firing of ink from the nozzles such as to create on the media a pattern of dots corresponding to the desired image. Different types of ink and different types of media may be used. Depending on the type of ink used, the ink may need to be actively dried and/or cured after being printed on the print medium. For example, in apparatus using latex ink, the ink is to be dried and cured, optionally in two separate stages. Drying of the ink requires evaporation of water present in the ink. Curing herein may be understood as hardening of the polymers in an ink which leads to the formation of a continuous film. Curing generally requires higher temperatures, such that the continuous film may be formed and a chemical bond is formed with the print medium.

The print medium may e.g. be separate sheets of paper. Particularly in large format printers, the print medium may be a continuous web, which is fed from a feed roll mounted on a spindle arranged in the printing apparatus and on which several different plots are printed one after the other.

In some known applications, an impingement module is used for drying ink printed on a print medium. Air is heated in a heating chamber and blown onto the print medium through a plurality of holes in an impingement plate. One problem associated with this kind of impingement module is the required warm-up time. Also, the cool-down time after printing which is dependent on the thermal inertia of the heater may be relatively long. During cool-down, media movement that could cause a print medium portion to be heated and deformed should be avoided. Yet another problem is that the energy efficiency of such modules may be quite low.

BRIEF DESCRIPTION OF THE DRAWINGS

In systems according to the examples of present invention, at least some of the above-mentioned problems can be resolved or reduced.

Particular examples of the present invention will be described in the following by way of non-limiting examples, with reference to the appended drawings, in which.

DETAILED DESCRIPTION

Figure 1A:
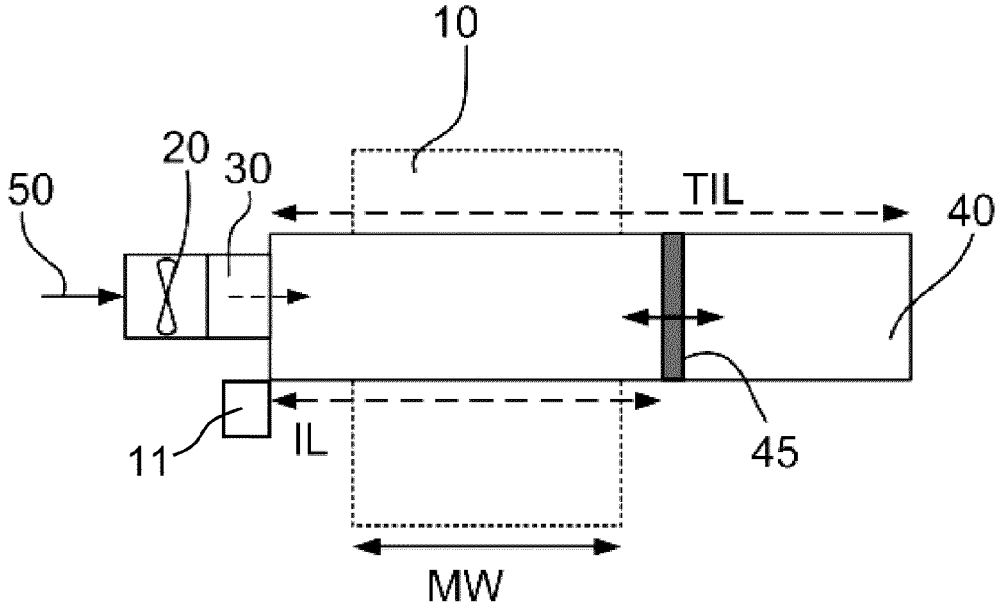
FIGS. 1*a* and 1*b* schematically illustrates an example of an impingement system.
Figure 1B:
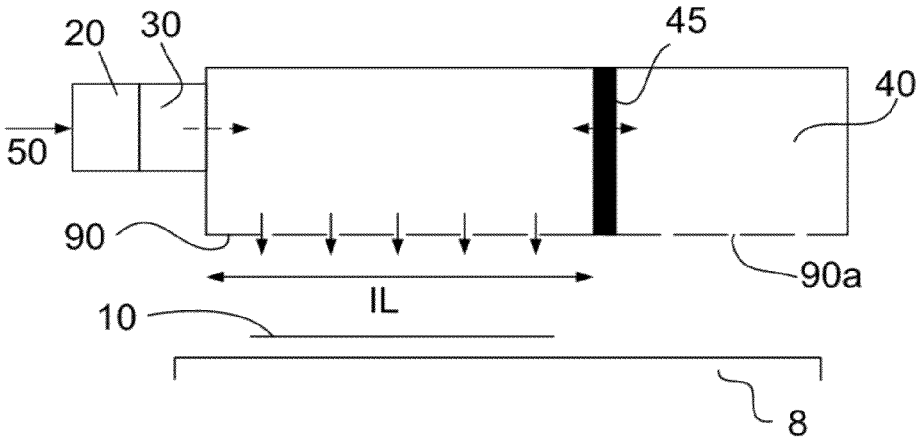

FIGS. 1*a* and 1*b* schematically illustrate respectively a top view and a cross-sectional view of an example of an impingement module which may be arranged in a printing apparatus. The impingement module may be arranged in or downstream from a print zone and may be used for drying and/or curing ink printed on print medium 10. The print medium moves along a medium path. In the shown area of the printing apparatus, the print medium 10 may be supported by medium support 8.

The impingement module may comprise a heater 30, and a blower in the form of a fan 20. The fan 20 moves the air through an air inlet 50 into the heating chamber 40. The heater 30 may be a coil heater and may heat the air inside the chamber 40 to a suitable temperature. The air inlet 50 may further comprise a suitable filter (not shown).

The bottom of the heating chamber 40 is formed by an impingement plate 90 having a plurality of holes 90*a*. The fan 20 forces the heated air through the holes 90*a* and jets of hot air impinge on the print medium 10. Ink printed on a print medium may be dried and/or cured by the hot air impinged on the print medium. In the illustrated case, the air impinges on the print medium 10 in a perpendicular manner.

In this example, a piston 45 that is movable along the length of the heating chamber may be provided. The piston 45 may act as a sidewall of the heating chamber and the piston may be displaced as a function of the width of the print medium. The impingement flux length IL may be defined as the length of the portion of the impingement plate through which heated air may be blown. The total potential impingement flux length TIL in this example corresponds to the length of the heating chamber 40. By adjusting the position of the piston 45 along the length, the impingement flux length IL may be adjusted.

With an impingement system according to this example, the whole heating chamber does not need to be heated. In function of the width of the print medium, the length of the heating chamber can be adjusted and the volume of the heating chamber reduced. The energy efficiency of the impingement system during printing may thus be improved compared to prior art impingement systems. Also the warm-up time of the impingement system before printing may be reduced, since a smaller volume of air needs to be heated up.

Similarly, the cool-down time after printing may be reduced. If piston 45 is moved to its furthest position, i.e. with a maximum "impingement flux length", the cool-down time may be reduced most, since in this case the warm air of the used parts of the heating chamber may be mixed with more relatively cold air.

In order to further increase the energy efficiency, at least a portion of the heated air that has been blown onto the print medium may be recirculated back through the air inlet 50 to the heater 20.

An aspect of impingement systems is that the heated air blown onto the print medium may be quite homogeneous. In order to ensure the homogeneity also at the edges of the print medium, the impingement flux length IL may be slightly larger than the width MW of the print medium such as is illustrated in FIGS. 1*a* and 1*b*.

A printing apparatus comprising an impingement system of FIG. 1 may further comprise a sensor 11 for determining the width of the print medium loaded in the apparatus. The impingement flux length may thus be adjusted automatically by driving the piston to the appropriate position. Any suitable driving mechanism may be used, such as e.g., a plunger with a screw thread or a hydraulic piston Alternatively, the width of the print medium may be obtained from user input, and a control system may adjust the position of the piston accordingly. Yet another option is for an operator to manually adjust the position of the piston.

Figure 2:
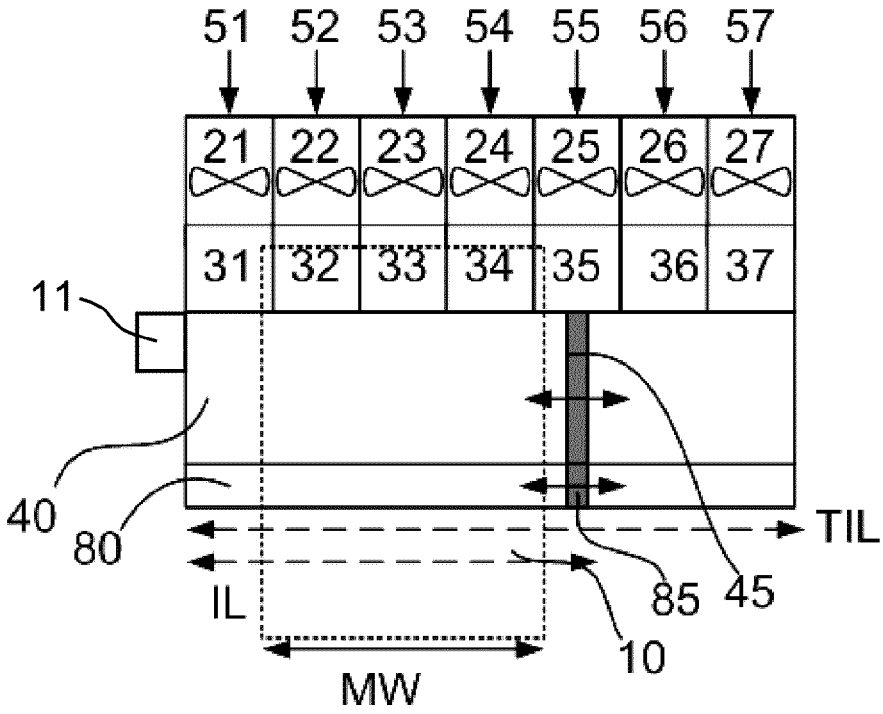
FIG. 2 schematically illustrates another example of an impingement system.

FIG. 2 schematically illustrates another example of an impingement system. The impingement system may comprise a plurality of fans 21-27 and a plurality of heaters 31-37. In an example, each fan may have its own inlet 51-57. In another example, the fans may share a common air inlet.

Also in this implementation, the length of the heating chamber 40 may be adjusted by moving a piston 45. The impingement flux length IL may thereby be adjusted to the width MW of the print medium 10.

Additionally, in this example the fans and heaters may be configured for being activated selectively to thereby further improve the energy efficiency. Only the fans and heaters that are arranged in the area of the print medium are activated. In the situation shown in FIG. 2, only fans 21-25 and heaters 31-35 are activated. Fans 26 and 27 and heaters 36 and 37 may be turned off or in a mode of low energy consumption. Energy may thus be saved.

Further shown in FIG. 2 is an example of a recirculation system. The recirculation system may comprise a plenum 80 for collecting air blown onto the medium. The air that is collected in the plenum 80 may be relatively warm air since it was heated before by one of the heaters 21-25. This warm air may be circulated back to the inlets 51-55 and heaters 21-25.

To further increase the efficiency of the system the width of the plenum 80 may be adjustable. The plenum may comprise a piston that is movable along its length to thereby adjust the plenum to the active length of the heating chamber, and thus to the width MW of the print medium 10. The capture and recirculation of relatively cold air may thereby be reduced or avoided. Such a recirculation system may also be used in the example of FIGS. 1*a* and 1*b*.

Figure 3A:
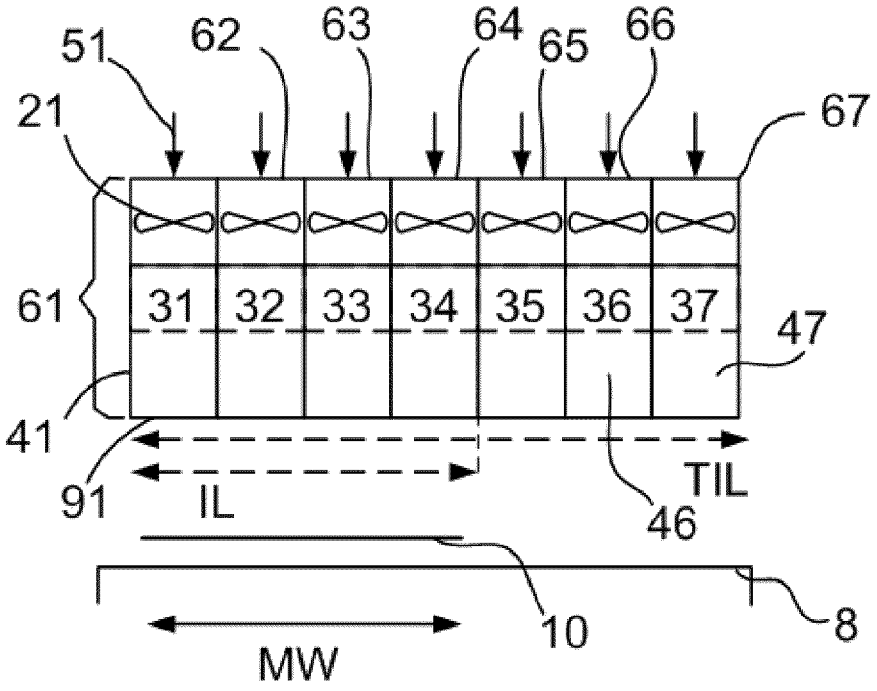
FIGS. 3*a* and 3*b* schematically illustrate a further example of an impingement system.
Figure 3B:
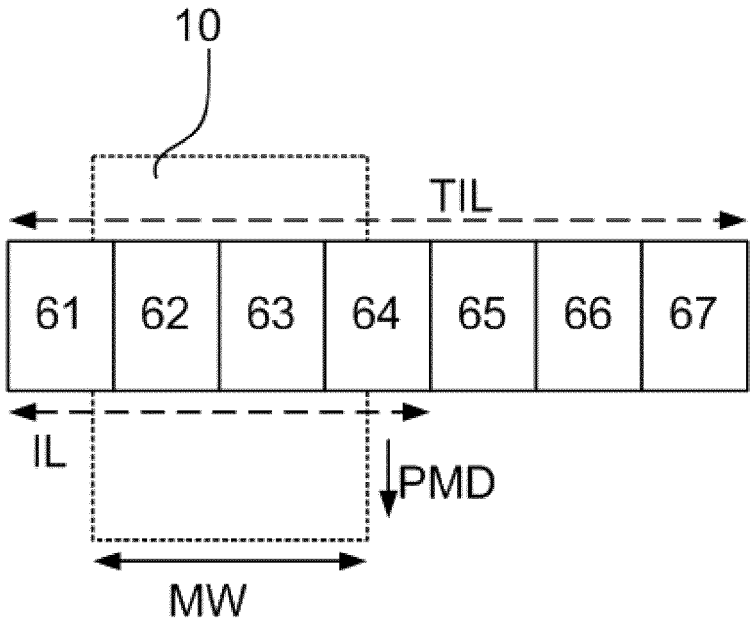

FIGS. 3*a* and 3*b* schematically illustrate a further example of an impingement system. FIG. 3*a* shows a schematic cross-sectional view, and FIG. 3*b* shows a top view. The impingement system in this case may comprise a plurality of modules 61-67. Module 61 comprises a heating chamber 41, a heater 31 to heat air in the heating chamber, an impingement plate 91 with a plurality of holes, and a fan 21 for blowing heated air through the holes of the impingement plate. Modules 62-67 comprise similar components. The number of modules may be varied in accordance with circumstances.

In this example, the heater may be arranged within the heating chamber, but in an alternative arrangement the heater may also be arranged outside the heating chamber in a manner similar to the examples shown in FIGS. 1 and 2. Furthermore, in this schematic illustration, each of the modules comprises a separate impingement plate. In an alternative arrangement, a single impingement plate covering the total potential impingement length TL may be provided, wherein each module comprises a corresponding portion of the impingement plate.

In the situation illustrated in FIGS. 3*a* and 3*b*, only modules 61, 62, 63 and 64 are activated. The impingement flux length may thus have the length of the four modules together and may thereby be adapted to the width of the print medium. Also in this arrangement, the energy efficiency of the impingement system may be improved, especially for print media with a reduced width.

An aspect of the arrangement with individually controllable modules is that the temperature and pressure in each of the heating chambers may be adjusted by controlling the individual heaters and fans. The temperature of the heating chambers at the edges of the print medium may be different from the heating chambers closer to a centre portion of the print medium. Also, if a plot along a particular portion of the print medium has a higher ink density, the temperature of the corresponding module may be increased.

A control of a printing apparatus comprising such an impingement system may adjust each of the modules based on measurements from a plurality of sensors (e.q., sensor 11 shown in FIG. 1*a*) that are adapted to determine the width of the print medium and/or e.g., ink density.

Figure 3C:
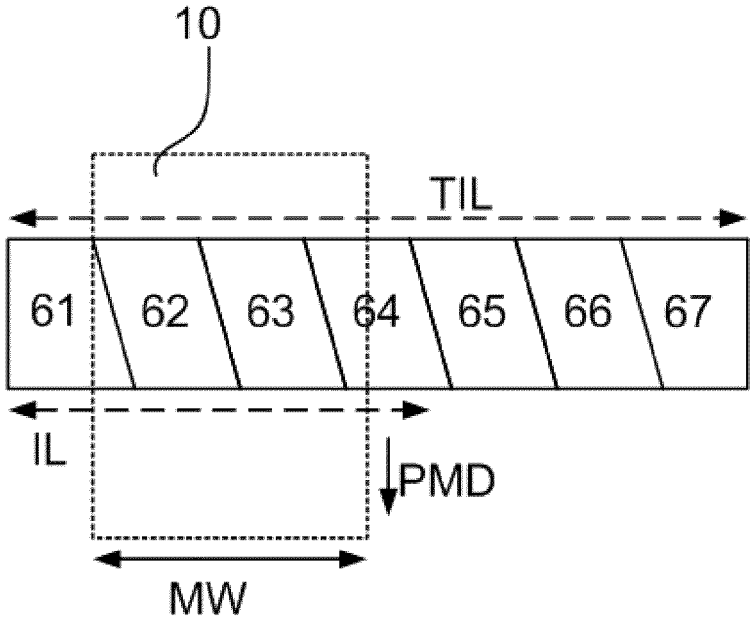
FIG. 3*c* illustrates a similar example, but with a small variation.

FIG. 3*c* illustrates a small variation on the impingement system shown in FIGS. 3*a* and 3*b*. In FIG. 3*b*, it may be seen that the sidewalls of the heating chamber of each of the modules extend substantially parallel to the local path of the print medium, i.e. the direction of movement of the print medium PMD. By arranging the sidewalls of the heating chambers of each of the modules inclined with respect to the local direction of movement of the print medium PMD in a manner illustrated in FIG. 3*c*, it may be avoided that a particular area of the plot (e.g. along the borders between modules) receives significantly less impingement air.

Figure 4:
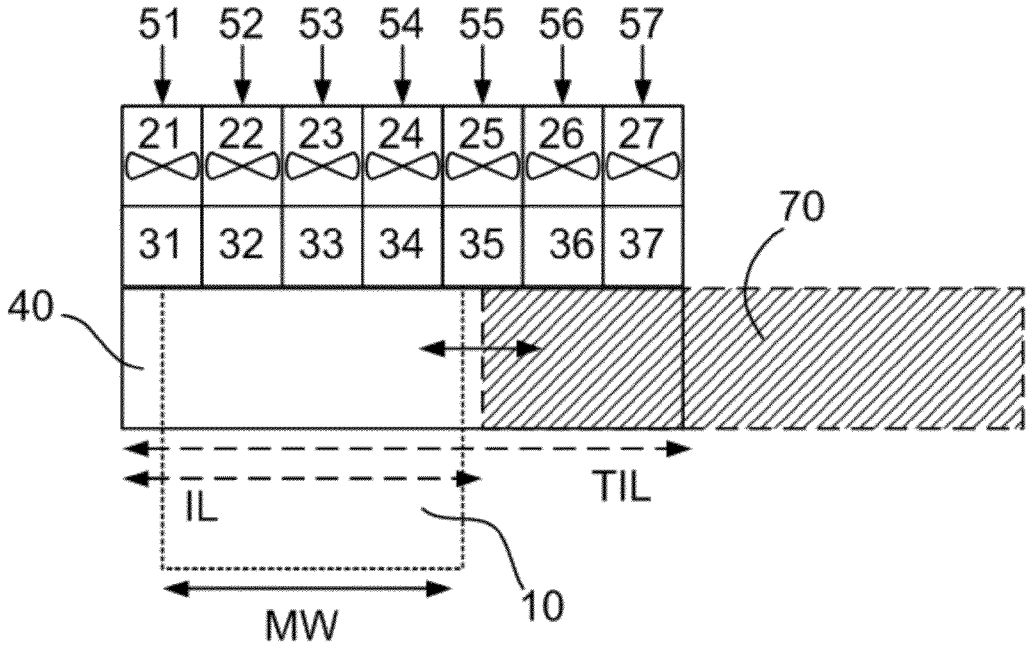
FIG. 4 schematically illustrates yet another example of an impingement system.

FIG. 4 schematically illustrates another example of an impingement system. In this case, a system for drying and/or curing ink printed on a print medium comprises a heating chamber 40, a plurality of heaters 31-37, and a plurality of fans 21-27. The fans blow heated air from the heating chamber 40 through the holes of an impingement plate 90 onto the print medium 10.

In this example, a displaceable cover 70 is provided. During operation, the position of the cover 70 may be adjusted as a function of the width of the print medium 10 so as to selectively block a portion of the holes of the impingement plate. The impingement flux length may thus also be reduced in this example. Since only a portion of the impingement holes is used, the energy efficiency of the impingement system may be improved.

A further option is to cover a portion of the impingement holes, or all of the impingement holes during warm-up. The warm-up time may be reduced significantly if the loss of warm air is reduced during this period. After warm-up, the cover 70 may assume a different position for operation.

In some implementations, the cover may be manually adjusted by an operator. Alternatively, a plurality of covers which may be manually put on and removed could be used. In further alternative implementations, an automatic system for driving the cover from one position to another may be used. Also in this case it would be possible to use more than one cover.

The concept of the cover blocking a portion or all of the impingement holes may also be combined with the concept illustrated in FIG. 3 of individually controllable modules, each comprising a heater, heating chamber and fan. In such a case, the cover may be arranged to slide in guiding rails just underneath the heating chambers. The cover may be used particularly for the warm-up phase of the printing apparatus.

Any suitable heater may be used in any of the examples illustrated in FIGS. 1-4, such as e.g. coil heaters or infrared lamps. Also, as an alternative to the fans illustrated in FIGS. 1-4, any other device capable of producing a current of air may be used as blower. Further, the impingement systems may be used for drying ink or for curing ink or for both. A separation of drying and curing may be employed in printing apparatus of high performance, e.g. high throughput.

Although only a number of particular embodiments and examples of the invention have been disclosed herein, it will be understood by those skilled in the art that other alternative embodiments and/or uses of the invention and obvious modifications and equivalents thereof are possible. Furthermore, the present invention covers all possible combinations of the particular embodiments described. Thus, the scope of the present invention should not be limited by particular embodiments, but should be determined only by a fair reading of the claims that follow.

The invention claimed is:

1. A system for supplying heated air to ink printed on a print medium comprising:

a heater to heat air, an impingement plate with a plurality of holes, a blower for blowing heated air through the holes of the impingement plate onto the print medium, and a piston that is displaceable relative to the impingement plate to a first position such that air blown by the blower is free to flow through a first portion of the plurality of holes and is restricted from flowing through a second portion of the plurality of holes by the piston.

2. A system according to claim 1, comprising a heating chamber formed by the impingement plate, a top wall and sidewalls connecting the impingement plate with the top wall wherein the son comprises one of the side walls.

3. A system according to claim 2, comprising a plurality of heaters and blowers.

4. A system according to claim 3, wherein the heaters and blowers are configured to be controlled individually or in groups.

5. A system according to claim 4, comprising a displaceable cover to selectively block a portion of the holes of the impingement plate.

6. A system according to claim 1, further comprising an air recirculation path for recirculating air blown onto the medium back to the heater.

7. A system according to claim 1, comprising a plurality of individually controllable modules, each of the modules comprising a heating chamber, a heater to heat air in the heating chamber, an impingement plate with a plurality of holes, and a blower for blowing heated air through the holes of the impingement plate portion.

8. A printing apparatus comprising a system according to claim 1.

9. A printing apparatus according to claim 8, further comprising a sensor for determining the width of the print medium.

10. A system for supplying heated air to ink printed on a print medium comprising:

a heating chamber formed by an impingement plate having a plurality of holes, a top wall, and sidewalls connecting the impingement plate with the top wall, a heater for heating air in the heating chamber, and a blower for blowing heated air through the holes of the impingement plate onto the print medium, wherein a first of the sidewalls is displaceable relative to the plurality of holes on the impingement plate to adjust the length of the heating chamber, wherein the first sidewall is displaceable to a first position wherein air blown by the blower is free to flow through a first portion of the plurality of holes and is restricted from flowing through a second portion of the plurality of holes by the first sidewall.

11. A system according to claim 10, wherein the first sidewall is a piston movable along the length of the heating chamber.

12. A system according to claim 10, comprising a plurality of selectively activable heaters and blowers.

13. A system according to claim 12, wherein the recirculation system comprises a plenum for collecting air blown onto the medium, and wherein the length of the plenum is adjustable.

14. A system according to claim 13, wherein the plenum comprises a piston that is movable along the length of the plenum.

15. A system according to claim 10, further comprising a recirculation system for recirculating air blown onto the medium back to the heater.

* * * * *